United States Patent [19]

Mieyal

[11] 4,397,127

[45] Aug. 9, 1983

[54] EXTENDABLE STUD FOR PARTITION WALLS OR THE LIKE

[75] Inventor: David F. Mieyal, Strongsville, Ohio

[73] Assignee: Donn, Incorporated, Westlake, Ohio

[21] Appl. No.: 189,128

[22] Filed: Sep. 22, 1980

[51] Int. Cl.[3] ..... E04H 1/00

[52] U.S. Cl. ..... 52/241; 52/632; 52/741

[58] Field of Search ..... 52/241, 632, 242, 741, 52/481

[56] References Cited

U.S. PATENT DOCUMENTS

| | | | |
|---|---|---|---|
| 2,154,520 | 4/1939 | Mackin . | |
| 3,008,550 | 11/1961 | Miles et al. | 52/241 X |
| 3,027,605 | 4/1962 | Nelsson . | |
| 3,492,766 | 2/1970 | Andrews | 52/632 X |
| 3,623,290 | 11/1971 | Downing, Jr. . | |
| 3,712,015 | 1/1973 | Nelson | 52/729 |
| 3,729,883 | 5/1973 | Thompson | 52/481 |
| 3,732,657 | 5/1973 | Nelsson | 52/241 |
| 3,897,668 | 8/1975 | McDonnell | 52/632 |
| 3,908,328 | 9/1975 | Nelsson | 52/735 |
| 3,952,462 | 4/1976 | Heise | 52/481 X |
| 3,998,027 | 12/1976 | Wendt et al. | 52/716 |
| 4,018,020 | 4/1977 | Sauer et al. | 52/241 |

*Primary Examiner*—Carl D. Friedman

*Attorney, Agent, or Firm*—Pearne, Gordon, Sessions, McCoy, Granger & Tilberry

[57] ABSTRACT

A metal stud assembly is disclosed for use in either drywall construction or as intermediate studs in demountable walls. The stud assembly includes a U-shaped stud member and a U-shaped stud extension which telescopes into one end of the stud member with a resilient-type of interference fit which produces a controlled resistance to relative axial movement and eliminates possible looseness. The stud extension is provided with angulated tabs which snap into a channel-shaped ceiling track to lock the stud extension therein. The lower end of the stud fits into a channel-shaped floor track to secure the lower end of the stud assembly in place. The stud assembly is sufficiently flexible to allow the lower end to be twisted through about 90° to position the narrow dimension thereof crosswise with respect to the floor track for easy insertion. After insertion, the stud assembly is returned to the untwisted position to complete the installation.

23 Claims, 5 Drawing Figures

EXTENDABLE STUD FOR PARTITION WALLS OR THE LIKE

BACKGROUND OF THE INVENTION

This invention relates generally to framing systems for partition walls or the like and, more particularly, to a novel and improved stud structure suitable for use in demountable walls and conventional drywall systems.

PRIOR ART

Various framing systems have been developed to reduce the cost and labor in the construction of partition structures. One well known system employs metal studs which are installed at their ends in floor and ceiling tracks and are used to support drywall panels. In such systems, the panels are usually secured to the framing studs by adhesive and/or drywall screws or fasteners. Usually, the joints between the panels are subsequently taped and finished to conceal the joints and fasteners.

Another wall system is known as a demountable wall system. Usually, such wall systems includes panels having kerfs along their edges which receive flanges of framing members to position and align the panels. These panels are often provided with a vinyl or other covering material which provides a finished exposed wall surface. Since the abutting edges provide a neat appearance and since they also conceal the flanges within the kerfs, taping or the like is not normally employed. Examples of such wall structures are described in U.S. Pat. Nos. 2,154,520; 3,027,605; 3,548,557; 3,623,290; 3,712,015; 3,729,883; 3,732,657; 3,908,328; and 3,998,027.

When demountable walls are constructed with wide panels, for example 4-foot wide panels, the edge support of the panels is often insufficient to provide the required strength and rigidity. It is therefore frequently necessary in such instances to install intermediate studs between the kerfed edge engaging studs to provide the required intermediate panel support. Generally in such instances, the studs are secured to the wall panels only with adhesive, since exposed fasteners are undesirable in systems using a prefinished surface.

SUMMARY OF THE INVENTION

The present invention is directed to the provision of a novel and improved stud that may be used with typical drywall systems and which may also be used as intermediate studs in demountable wall systems.

This improved stud is provided with a stud extension which telescopes with respect to the main stud structure to make the stude length-adjustable. Thus, virtually all on-site cutting of the stud is eliminated and the stud can accommodate variations in floor-ceiling spacing. Preferably, an interference fit prevents looseness and provides a frictional drag resisting relative axial movement. Further, it is preferable to provide the stud extension with snap means to lock into the upper track of the wall system by the simple expedient of pressing the stud upward to engage such lock means. Such locking of the stud extension in the ceiling track allows the main structure of the stud to be slid down along the stud extension and to be positioned in the lower track, completing the installation of the stud.

In the illustrated embodiment, the stud is generally U-shaped, providing two opposed panel-engaging leg portions maintained in spaced relationship by a central web joined to the wall-engaging portions at one edge thereof. The free ends of the wall-engaging portions are provided with inturned flanges to engage the free edges of a U-shaped stud extension. These flanges cooperate with the remainder of the stud to connect the stud and stud extension for telescoping axial movement. The reverse bends also provide additional stiffening of the system. The U-shaped stud extension also provides panel-engaging leg portions having a spacing substantially the same as the corresponding portions of the stud itself so that full panel support is provided even when the extension is extended.

Adjacent to the upper edges of the stud extension are a pair of tabs cut from the material thereof and extending laterally from the panel-engaging surfaces to provide the snap lock mounting of the stud extension in the upper track.

The center wall or web of the stud extension is also provided with at least one additional stop tab spaced from the end thereof a greater distance than the lock tabs and proportioned to engage the web of the main stud member to limit the inward telescoping movement of the extension and to ensure that the lock tabs are spaced from the end of the main stud member for proper insertion into the ceiling track.

The width of the panel-engaging portions is less than the width of the central web of the stud so that the stud has a width greater than its thickness. With such structure, installation of the lower end of the stud into the floor track can be accomplished by twisting the stud through about 90 degrees so that its narrow dimension is in alignment with the floor track for easy insertion into the floor track. After the insertion of the lower end of the stud, the stud is rotated back to its normal position and snaps into place. Because the floor track and the stud are able to deform to some extent and then return to their original dimension, such rotation back to the untwisted condition does not result in any permanent deformation of either of them. This procedure provides a simple and quickly accomplished installation of the stud.

These and other aspects of the invention are more fully described and illustrated in the following description of the drawings.

DETAILED DESCRIPTION OF THE DRAWINGS

Figure 2:
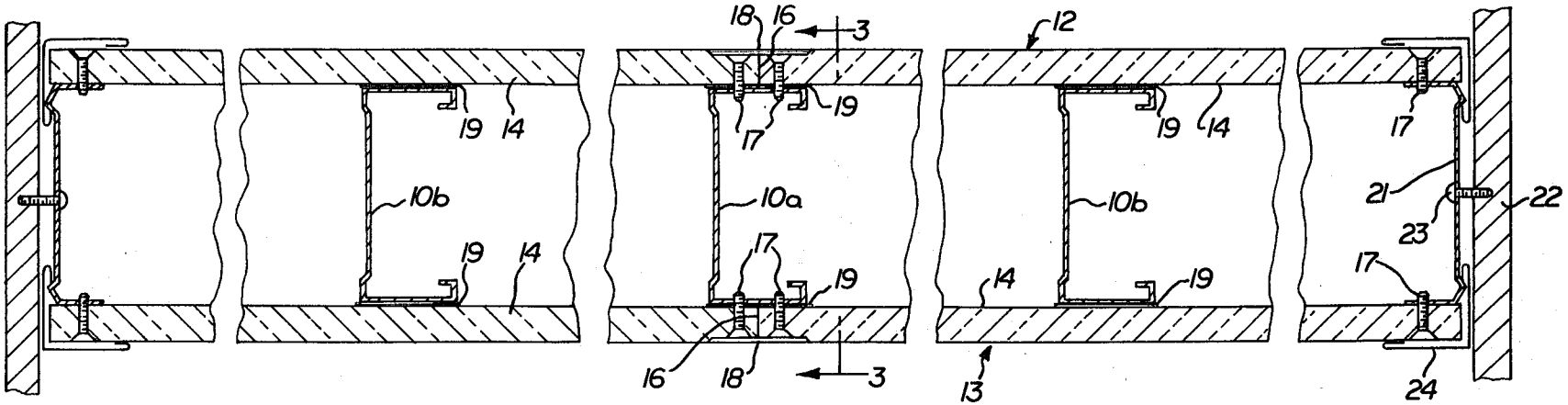
FIG. 2 is a broken plan section illustrating an assemnbled wall in accordance with the present invention.
Figure 1:
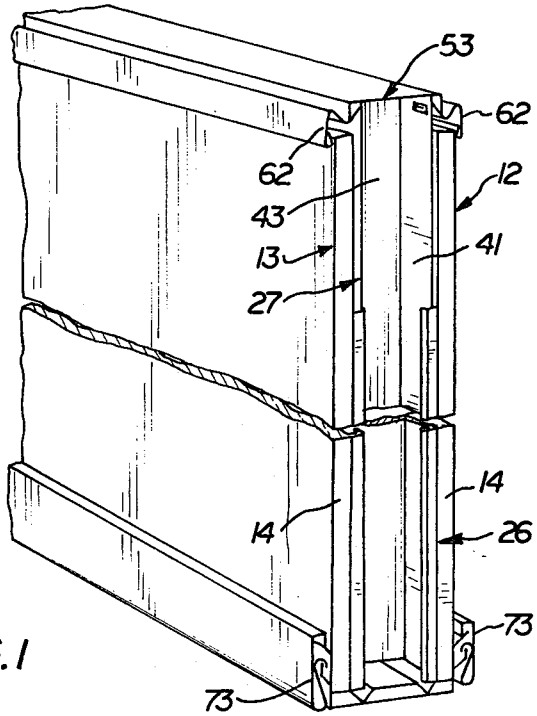
FIG. 1 is a fragmentary, perspective view illustrating a wall with a stud in accordance with the present invention mounted therein.

FIGS. 1 and 2 illustrate an assembled drywall system provided with studs in accordance with the present invention. Such wall includes a plurality of spaced stud assemblies 10 positioned at intervals along the length of the wall. These stud assemblies are positioned within a wall consisting of spaced and parallel rows 12 and 13 of edgewise abutting wallboard panels 14. In the illustrated embodiment, the wallboard panels are preferably formed of gypsum board, which abut at a joint 16 on either side of a central stud assembly 10*a*. Normally, the edges of such boards are beveled and are secured with drywall fasteners 17 to the opposite sides of the stud assembly 10*a* and are taped at 18 to provide a finished joint. In addition, adhesive 19 is often applied to eliminate any looseness or rattling.

Positioned between the edges of the panels 14, in instances where the panels are relatively wide, are intermediate stud assemblies 10*b* of the same structure as the stud assembly 10*a*. Here again, a layer of adhesive 19 is applied between the studs and the panels 14 and, if desired, additional fasteners are used (not illustrated) to connect to the intermediate stud assemblies 10*b*.

A completed wall usually includes end brackets 21 which are secured to a perpendicular wall structure 22 by fasteners 23, and drywall fasteners 17 are employed to secure the adjacent edges of the panels 14 to the legs of the brackets 21. An L-shaped finish strip 24 may be employed or the joint between the panels and the adjacent wall 22 may be taped if desired.

Figure 5:
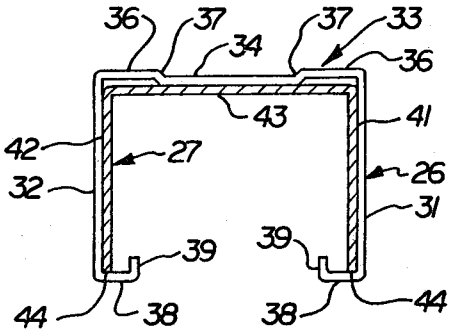
FIG. 5 is an enlarged cross section illustrating the shape of both the stud and the stud extension.
Figure 3:
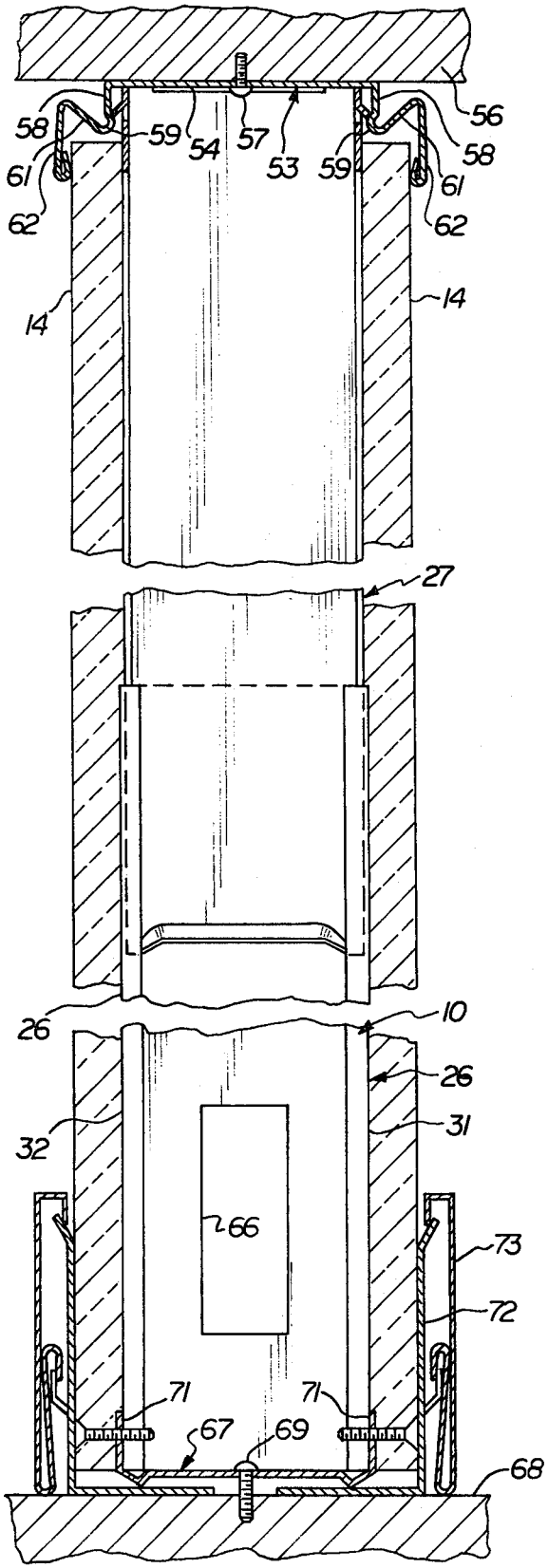
FIG. 3 is a vertical section taken along line 3—3 of FIG. 2.
Figure 4:
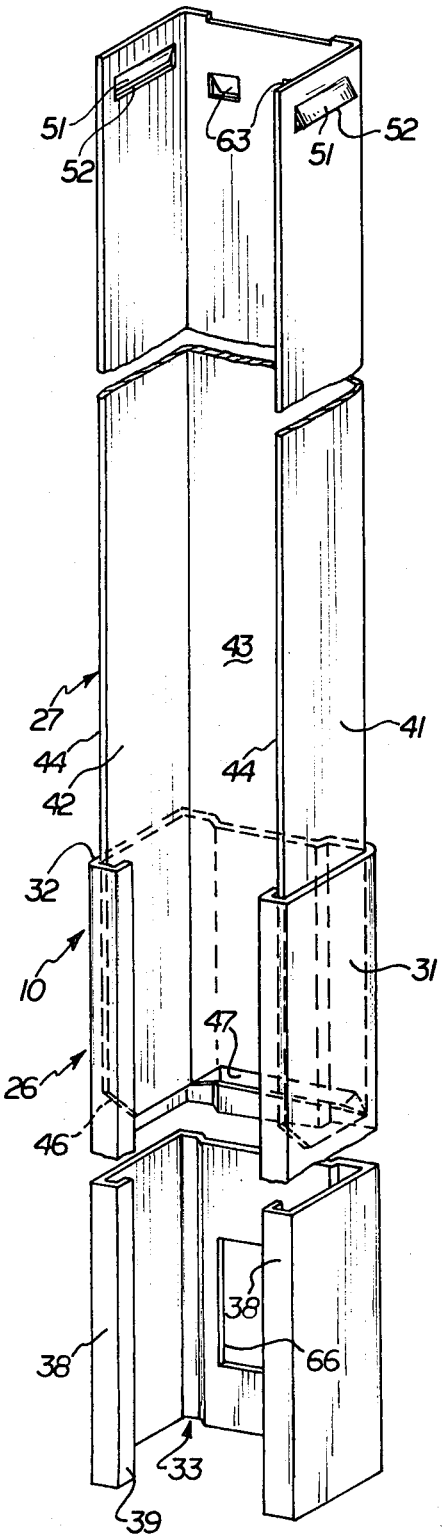
FIG. 4 is an enlarged perspective view illustrating the structure of the stud and its telescoping extension.

Referring now to FIGS. 3 through 5, the stud assemblies 10 include a U-shaped stud member 26 and a U-shaped stud extension 27 which telescopes into the upper end of the stud member 26. Preferably, both elements are formed of sheet metal bent to the required shape.

As best illustrated in FIG. 5, the stud member 26 is generally U-shaped providing opposed panel-engaging wall leg portions 31 and 32 joined at one edge to a web 33. The central portion 34 of the web is offset slightly in an inward direction from the outer portions 36 of such web. This offset is accomplished by shallow bends at 37 on each side of the center portion 34. The other edges of the wall-engaging portions 31 and 32 are provided with an inturned flange 38 and a short reverse bend 39, which cooperate to give stiffness to the free ends of the stud member 26.

The stud extension 27 is also U-shaped and provides opposed and substantially parallel legs or walls 41 and 42 which are positioned adjacent to the associated panel-engaging portions 31 and 32, respectively. A stud extension web 43 joins the edges of the walls 41 and 42 and engages the offset central portion 34 of the web of the stud member 26 but is spaced from the outer web portions 36 a slight distance because of the offset. The free edges 44 of the two walls 41 and 42 fit against the associated flanges 38.

The stud extension is proportioned so that it fits with slight interference into the stud member 26 and is guided for telescoping movement in an axial direction with respect thereto. Because of the space between the web 43 and the outer web portions 36 of the stud member, the wall-engaging portions do not provide a positive interference with the associated walls and such interference merely causes a slight spring-type deflection of the two webs 33 and 43. Such interference, therefore, does not create excessive resistance to telescoping movement, but merely causes a controlled amount of frictional drag resisting the telescoping movement. Therefore, the parts tend to remain in any given position with respect to each other but can be moved with respect to each other without excessive forces. Further, the interference prevents any rattling between the parts which would exist if the parts loosely fitted together.

Referring to FIG. 4, the ends of the walls 41 and 42 are cut off at an angle to form a chamfer at 46 to facilitate the entry of the stud extension into the end of the stud member. In addition, the end of the web is bent inwardly at 47 to provide a camming action as the stud extension 27 is started into the member 26. This ensures easy assembly of the parts even though the parts are dimensioned to provide a slight interference.

Adjacent to the upper end of the stud extension 27 a tab 51 is cut in each of the walls 41 and 42 and is bent out to provide an inclined free edge 52 proportioned to lock with a channel-shaped ceiling track 53, as best illustrated in FIG. 3. Such track is provided with a flat central portion 54 secured against the ceiling 56 by a fastener 57. At opposite edges of the central portion 54, the track 53 is provided with a downwardly extending wall 58 terminating at an inwardly extending shoulder provided by a bend 59 and then extends upwardly along a portion 61 to a skirt 62. The skirt 62 is proportioned to fit down over the upper edge of the panels 14 to cover such edge and also to hold them against the adjacent parts of the stud assembly.

The spacing between the edges 52 of the tabs 51 and the inturned bend 59 is such that once the stud extension is pressed up into the ceiling track 53, the edges of the tabs lock against the associated shoulder provided by the inturned bends 59 to lock the stud extension in the track. However, the stud extension can be moved lengthwise of the track in its installed condition. The installation of the stud extension is accomplished by merely pressing it upward into the track, snapping the tabs 51 past the bend 59, whereupon the members spring back to the position of FIG. 3 and the stud extension is securely held in place.

As illustrated in FIG. 4, a pair of stop tabs 63 are cut from the web 43 and bent out in a rearward direction so as to engage the web 33 of the stud member 26 and limit telescoping movement of the stud extension into the stud member by such engagement. The two tabs 63 are spaced from the end of the stud extension a distance greater than the spacing between the tabs 51 and the end of the stud extension, so that when the tabs 53 engage the end of the web 33 the tabs 51 are spaced up from the end of the stud member 26 to ensure that the tabs are clear to be snapped into the ceiling track 53.

Cutouts 66 are formed in the web 34 of the stud member 26 at intervals along the length thereof to allow feeding of wire or other services through the stud along the wall.

Preferably, the web 33 has a width greater than the wall-engaging portions 31 and 32 so that the stud is wider than it is thick. With such proportions, the lower end of the stud can be easily positioned within a floor track 67, as described below. The floor track is secured to the floor 68 by fasteners 69 and provides a pair of upstanding flanges 71 which are spaced apart a distance dimensioned to resiliently engage the opposite wall-engaging portions 31 and 32.

The wall is constructed by first installing the channel-shaped ceiling track 53 and floor track 57. The studs are then pressed up into the ceiling track, locking the stud extensions therein, and the stud is pulled down along the stud extensions while it is twisted approximately 90 degrees and is positioned in the floor track at its lower end. This twisting of the stud positions the narrow dimension of the lower end of the stud perpendicular to the length of the floor track channel so that it can be easily inserted with clearance. The stud is then rotated back to its untwisted proper installed position, in which the stud extension is locked in the ceiling track and the lower end of the stud member 26 is properly positioned in the floor track. The stud metal can be twisted in such manner without permanent deformation, and the walls of the floor track are sufficiently resilient to cause them to snap back into tight engagement with the portions 31 and 32 when the twist is removed. The snap lock in the upper track prevents rotation of the upper end when the stud is twisted.

Because the stud extension makes the overall length of the installed stud assembly adjustable, it is not normally necessary to provide any on-site cutting of the stud assembly, and any variations in floor-to-ceiling spacing are accommodated by the stud extension.

The panels 14 are then installed with suitable fasteners and/or adhesive to secure the panels to the studs and the floor track. In drywall installations, the joints are then taped and finished. When the stud assembly is used as an intermediate stud in a demountable wall, fasteners are normally not used but adhesive is applied to the wall-engaging portions of the stud assembly to connect the panels to the intermediate studs.

After the installation of the panels, baseboard clips 72 are installed by pressing the lower leg thereof under the floor track and a baseboard 73 is installed to finish the wall.

Because the stud member is formed of relatively thin metal and because the wall portions 41 and 42 are adjacent to the wall-engaging portions 31 and 32, respectively, the wall portions 41 and 42 are substantially in the same plane as the associated panel-engaging portions and constitute panel-engaging portions of the stud extension which engage the inner surface of the panels and provide a base for adhesive or fastener connection therewith. Therefore, the stud assembly provides panel support along its entire length, regardless of the telescoped position of the stud extension. Further, since the stud extension tightly engages the stud member, a strong, solid structure is provided in which there is essentially no rattling or looseness. In a typical installation, the stud extension is about one foot long and the stud members have a length of about 6 inches less than the nominal spacing between the floor and ceiling tracks. With such proportions, only about one-half the stud extension extends beyond the stud member when the stud assembly is installed and, in such installed position, approximately six inches of the stud extension telescopes into the stud member to ensure a good connection therebetween.

Although the preferred embodiment of this invention has been shown and described, it should be understood that various modifications and rearrangements of the parts may be resorted to without departing from the scope of the invention as disclosed and claimed herein.

What is claimed is:

1. A stud assembly for use in walls between floor and ceiling tracks, comprising a stud member providing opposed panel-engaging portions, a stud extension member shaped to telescope with said stud member, one of said members providing lock means operable to lock with one of said tracks in response to lengthwise movement of said one member relative to said one track and retain said members interlocked as the other of said members is moved to engage the other of said tracks, said members having an assembled length when fully telescoped which is less than the spacing between said tracks, said lock means permitting locking of said one member at substantially any location along the length of said one track and movement of said one member along said one track while said locking means remains locked.

2. A stud assembly as set forth in claim 1, wherein said lock means are operable to lock in said ceiling track, and said other of said members is engagable with said floor track.

3. A stud assembly as set forth in claim 1, wherein said members each provide a pair of opposed, substantially parallel panel-engaging surfaces, each panel-engaging surface on said stud extension member being substantially coplanar with a panel-engaging surface of said stud member.

4. A stud assembly as set forth in claim 3, wherein said stud extension member telescopes into said stud member.

5. A stud assembly as set forth in claim 4, wherein said stud member and said stud extension member are substantially U-shaped and wherein said lock means are provided on said stud extension member.

6. A stud assembly as set forth in claim 5, wherein said members are formed of metal, said floor track is a channel having opposed walls sized to tightly receive said panel-engaging surfaces at the lower end of said stud member, said stud member web is wider than its legs, and said assembly can be twisted through substantially 90 degrees without permanent deformation.

7. A stud assembly as set forth in claim 1, wherein said members are sized to telescope with an interference fit causing resilient deflection thereof to prevent looseness and a frictional drag resisting relative axial motion therebetween.

8. A stud assembly for walls having floor and ceiling tracks comprising a U-shaped stud member providing a central web and a pair of spaced parallel legs extending from said web, a U-shaped stud extension having a web and a pair of parallel legs proportioned to telescope with one end of said stud and being axially movable relative thereto, the outer of said legs being provided with an inward flange at the end thereof, one of said members providing snap lock means operable to lock with one of said tracks and provide a connection therewith, allowing the other of said members to slide relative thereto for mounting on the other of said tracks, said stud assembly accommodating variations in spacing between said tracks, said lock means permitting movement of said one member along said one track while said lock means remains in locking engagement.

9. A stud assembly as set forth in claim 8, wherein said stud extension telescopes into said stud member and said lock means are formed on said stud extension.

10. A stud assembly as set forth in claim 9, wherein said lock means are operable to lock with said ceiling track, and said stud member engages said floor track, said lock means providing sufficient resistance to prevent rotation of said stud extension with respect to said ceiling track when the opposite end of said stud is rotated through substantially 90 degrees for insertion into said floor track.

11. A stud assembly as set forth in claim 10, wherein said snap lock means are provided by angulated tabs projecting from the legs of said stud extension engageable with shoulders on said ceiling track.

12. A stud assembly as set forth in claim 11, wherein stop means are provided to limit movement of said stud extension into said stud to maintain a spacing between said tabs in the end of said stud member.

13. A stud assembly as set forth in claim 8, wherein each leg of said stud extension is adjacent to an associated leg of said stud member and in substantially the same plane therewith, said associated legs providing wall panel-engaging surfaces extending substantially the entire length of said stud assembly.

14. A stud assembly as set forth in claim 13, wherein said webs are adjacent and shaped to provide an interference fit to prevent looseness and to cause resilient deflection thereof producing friction to resist relative axial movement therebetween.

15. A stud assembly as set forth in claim 14, wherein said one of said webs is formed with a central portion offset toward the other of said webs to provide said interference fit with a portion thereof, and the remaining portions of said webs being spaced apart.

16. A stud assembly as set forth in claim 15, wherein cam means are provided to facilitate initial telescoping assembly of said stud member and said stud extension.

17. A stud assembly as set forth in claim 16, wherein said stud extension telescopes into said stud member and said offset is formed in the web of said stud member.

18. A stud assembly as set forth in claim 17, wherein said snap lock means are provided by angulated tabs projecting from the legs of said stud extension which are engageable with shoulders on such ceiling track.

19. A stud assembly as set forth in claim 18, wherein stop means are provided to limit movement of said stud extension into said stud to maintain a spacing between said tabs and the end of said stud.

20. A stud assembly as set forth in claim 19, wherein said stop means are provided by angulated tabs projecting from the web of said stud extension at a location spaced from the ends thereof a greater distance than said snap lock means.

21. A stud assembly for walls having floor and ceiling tracks comprising a U-shaped stud member providing a central web, a pair of spaced parallel legs extending from said web, and an inward flange at the edge of each leg spaced from said web, and a U-shaped stud extension having a web and a pair of parallel legs proportioned to telescope with one end of said stud and being axially movable relative thereto, one of said webs providing an offset portion shaped to provide an interference fit with the other of said webs and prevent looseness between said stud and said stud extension, and to cause resilient deflection thereof producing friction resisting relative axial movement therebetween, said stud extension being formed with angulated tabs projecting from the legs thereof engageable with shoulders on said ceiling track to lock said stud extension to said ceiling track at substantially any location along said track, stop means provided on said stud extension operable to limit movement of said stud extension into said stud to maintain a spacing between said angulated tabs and the end of said stud member, said stud member web being wider than its legs so that said stud assembly can be twisted through substantially 90 degrees to position the lower end of said stud member in said floor track with clearance and allowing said stud member to be twisted back to an installed position in which said stud assembly is not twisted, said angulated tabs providing sufficient resistance to rotation with respect to said ceiling track to prevent rotation therebetween when the opposite end of said stud assembly is twisted through substantially 90 degrees at substantially any location along said floor track.

22. A method of installing stud assemblies in wall systems having channel-shaped floor and ceiling tracks, and wherein said stud assembly includes a stud member and a stud extension telescoped together, comprising locking one of said members in one of said tracks against axial movement relative thereto, and moving the other of said members relative to said one member until the end thereof is located within the other of said tracks, and wherein a frictional drag is provided between said stud member and said stud extension to resist relative axial movement therebetween and looseness therebetween, and said stud extension is locked in said ceiling track against axial movement relative thereto while said stud member is moved down relative to said stud extension until the lower end thereof is located within said floor track.

23. A method of installing stud assemblies in wall systems having channel-shaped floor and ceiling tracks, and wherein said stud assembly includes a stud member and a stud extension telescoped together, comprising locking said stud extension in said ceiling track against axial and rotational movement relative thereto, twisting said stud assembly to position a narrow dimension of the lower end thereof substantially perpendicular to said lower track and while so twisted moving said stud member down relative to said stud extension until the lower end of said stud member is located within said floor track, and thereafter rotating said stud assembly until the twist is removed therefrom and said lower end is tightly embraced within said floor track.

* * * * *